US006787228B2

(12) United States Patent
Campbell et al.

(10) Patent No.: US 6,787,228 B2
(45) Date of Patent: Sep. 7, 2004

(54) FLAME-RESISTANT AND HIGH VISIBILITY FABRIC AND APPAREL FORMED THEREFROM

(75) Inventors: Willis D. Campbell, Summerfield, NC (US); Richard M. Gibson, Weaverville, NC (US); Albert E. Johnson, Burlington, NC (US); Kenneth P. Wallace, Burlington, NC (US)

(73) Assignee: Glen Raven, Inc., Glen Raven, NC (US)

( * ) Notice: Subject to any disclaimer, the term of this patent is extended or adjusted under 35 U.S.C. 154(b) by 38 days.

(21) Appl. No.: 10/135,733

(22) Filed: Apr. 30, 2002

(65) Prior Publication Data

US 2003/0203688 A1 Oct. 30, 2003

Related U.S. Application Data

(63) Continuation-in-part of application No. 09/851,888, filed on May 9, 2001, now Pat. No. 6,706,650.

(51) Int. Cl.[7] ..... B32B 5/16

(52) U.S. Cl. ..... 428/365; 427/157; 428/364; 428/920; 428/921; 442/130; 442/164; 442/167

(58) Field of Search ..... 442/130, 164, 442/167; 428/920, 921, 364, 365; 427/157

(56) References Cited

U.S. PATENT DOCUMENTS

| | | | | | |
|---|---|---|---|---|---|
| 3,670,068 | A | * | 6/1972 | Jones et al. | 264/182 |
| 3,729,920 | A | * | 5/1973 | Sayers et al. | 57/227 |
| 3,806,959 | A | | 4/1974 | Gross | 5/334 R |
| 3,925,016 | A | * | 12/1975 | Haase | 8/580 |
| 4,001,477 | A | | 1/1977 | Economy et al. | 428/224 |
| 4,035,542 | A | | 7/1977 | Rosenthal et al. | 428/224 |
| 4,084,027 | A | | 4/1978 | Berni et al. | 427/390 D |
| 4,151,322 | A | | 4/1979 | Rosenthal et al. | 428/254 |
| 4,167,603 | A | | 9/1979 | Sistrunk | 428/260 |
| 4,266,940 | A | * | 5/1981 | Blackburn et al. | 8/538 |
| 4,336,028 | A | * | 6/1982 | Tomibe et al. | 8/624 |
| 4,348,306 | A | | 9/1982 | Mischutin | 252/608 |
| 4,433,493 | A | | 2/1984 | Poisson | 34/116 |
| 4,732,804 | A | | 3/1988 | Kujas | 428/229 |
| 4,970,105 | A | | 11/1990 | Smith, Jr. | 428/198 |
| 4,996,099 | A | * | 2/1991 | Cooke et al. | 442/4 |
| 5,033,262 | A | | 7/1991 | Montgomery et al. | 57/5 |
| 5,114,786 | A | | 5/1992 | Louis | 428/270 |
| 5,180,793 | A | | 1/1993 | Vigneault et al. | 525/446 |
| 5,323,815 | A | | 6/1994 | Barbeau et al. | 139/420 A |
| 5,348,796 | A | | 9/1994 | Ichibori et al. | 428/224 |
| 5,397,509 | A | | 3/1995 | Kostrzecha | 252/607 |
| 5,448,779 | A | | 9/1995 | Aldridge | 2/326 |
| 5,478,154 | A | | 12/1995 | Pappas et al. | 383/117 |
| 5,486,412 | A | | 1/1996 | Weinrotter et al. | 428/288 |
| 5,496,623 | A | | 3/1996 | Fox | 428/224 |
| 5,503,915 | A | | 4/1996 | Ichibori et al. | 428/224 |
| 5,503,916 | A | | 4/1996 | Ichibori et al. | 428/224 |
| 5,506,042 | A | | 4/1996 | Ichibori et al. | 428/224 |
| 5,688,429 | A | | 11/1997 | Zakikhani et al. | 252/8.61 |
| 5,728,448 | A | | 3/1998 | Okeya et al. | 428/193 |
| 5,855,623 | A | * | 1/1999 | English et al. | 442/124 |
| 5,948,148 | A | | 9/1999 | Cuevas B. | 106/18.13 |
| 6,102,128 | A | | 8/2000 | Bridgeman | 169/49 |
| 6,287,686 | B1 | | 9/2001 | Huang et al. | 428/362 |
| 6,358,608 | B1 | | 3/2002 | Hanyon et al. | 428/362 |

FOREIGN PATENT DOCUMENTS

| | | | | |
|---|---|---|---|---|
| GB | 2152542 A | * | 8/1985 | D04B/1/14 |

OTHER PUBLICATIONS

Pages of brochure for Westex Inc., believed to be prior art, date unknown.
Website printout for Head Lites Corporation, believed to be prior art, date unknown.

* cited by examiner

*Primary Examiner*—Elizabeth M. Cole
*Assistant Examiner*—Norca L. Torres
(74) *Attorney, Agent, or Firm*—Womble Carlyle Sandridge & Rice, PLLC; C. Robert Rhodes

(57) ABSTRACT

A yarn, fabric, and apparel formed from modacrylic fibers and high energy absorptive fibers. When the yarn is formed into a fabric comprised substantially of the yarn, the fabric meets the American Society for Testing and Materials standard for flame resistance and the National Fire Protection Association standard for arc thermal performance exposure.

37 Claims, No Drawings

FLAME-RESISTANT AND HIGH VISIBILITY FABRIC AND APPAREL FORMED THEREFROM

RELATED APPLICATIONS

This is a continuation-in-part of application Ser. No. 09/851,888, filed May 9, 2001, now U.S. Pat No. 6,706,650 Mar. 16, 2004 the content of which is hereby incorporated in its entirety.

FIELD OF THE INVENTION

The present invention relates generally to yarns, fabric and safety apparel formed therefrom, and more particularly to fabric and apparel that meets nationally-recognized standards for flame-resistance, high-visibility, and electric arc resistance.

BACKGROUND OF THE INVENTION

Authorities worldwide have recognized the need to protect occupational workers from the inherent hazards of apparel that is deficient in contrast and visibility when worn by workers exposed to the hazards of low visibility. These hazards are further intensified by the often complex backgrounds found in many occupations such as traffic control, construction, equipment operation, and roadway maintenance. Of major concern is ensuring that these workers are recognized by motor vehicle drivers in sufficient time for the drivers to slow-down or take other preventive action to avoid hazard or injury to the workers. Thus, worker safety is jeopardized when clothing not designed to provide visual identification is worn by persons working in such dangerous environments. While there are no federal regulations governing the design, performance, or use of high-visibility apparel, local jurisdictions and private entities have undertaken to equip their employees with highly luminescent vests. One national standards organization, known as the American National Standards Institute (ANSI), in conjunction with the Safety Equipment Association (ISEA), has developed a standard and guidelines for high-visibility luminescent safety apparel based on classes of apparel.

Similarly, and in related fashion, certain of the above-mentioned occupations also require safety apparel that is flame resistant or electric arc resistant. For example, electric utility workers who may be exposed to flammable situations or to momentary electrical arc require apparel that is flame and/or arc resistant. In the United States, there is a nationally-recognized standard providing a performance specification for flame resistant textile materials for safety apparel, referred to as the American Society for Testing and Materials (ASTM), standard F 1506. This standard provides performance properties for textile materials used in apparel that represent minimum requirements for worker protection. One component of this standard is the vertical flame test which measures whether an apparel will melt or drip when subjected to a flame, or continue to burn after the flame is removed. A second component of flame resistance is arc thermal performance which is tested in accordance with ASTM standard F 1959 to meet acceptance criteria found in National Fire Prevention Association (NFPA) Standard 70E.

Until recently, various items of safety apparel were produced to meet one or the other of these nationally-recognized standards, but none were known in the art that were capable of meeting all of the standards for flame-resistance, electric arc resistance, and high-visibility. There are now known, however, fabric and apparel formed therefrom that will meet the minimum requirements for high-visibility and that will meet the vertical flame test for flame-resistance. As of the date of this invention, however, no fabric or apparel has heretofore been developed that will satisfy the above standards for high-visibility and flame-resistance, as well as arc thermal performance.

SUMMARY OF THE INVENTION

The present invention is directed to a yarn, fabric, and apparel formed therefrom, that meets the minimum guidelines laid out in ANSI/ISEA-107-1999, "American National Standard for High-Visibility Safety Apparel", the vertical flame test of ASTM F 1506, "Standard Performance Specification for Flame Resistant Textile Materials for Wearing Apparel for Use by Electrical Workers Exposed to Momentary Electric Arc and Related Thermal Hazards", and the electric arc thermal performance criteria of NFPA 70E, "Electrical Safety Requirements for Employee Workplaces" when tested in accordance with ASTM F 1959, "Standard Test Method for Determining the Arc Thermal Performance Value of Materials for Clothing".

ANSI/ISEA-107-1999 specifies requirements for apparel capable of signaling the wearer's presence visually and intended to provide conspicuity of the wearer in hazardous situations under any light conditions by day, and under illumination by vehicle headlights in darkness. As used herein, and as defined in ANSI/ISEA-107, "conspicuity" refers to the characteristics of an object which determine the likelihood that it will come to the attention of an observer, especially in a complex environment which has competing foreground and background objects. Conspicuity is enhanced by high contrast between the clothing and the background against which it is seen. The ANSI standard specifies performance requirements for color, luminance, and reflective area. Three different colors for background and combined performance are defined in the standard. The color selected should provide the maximum contrast with the anticipated background for use of the apparel. Several combinations are described in the standard depending upon the intended use. For example, the ANSI standard describes three classes of conspicuity. For utility workers, the apparel would meet either Class 2 or Class 3 (Appendix B of ANSI 107-1999).

ASTM F 1506 provides a performance specification that may be used to evaluate the properties of fabrics or materials in response to heat and flame under controlled laboratory conditions. For exposure to an open flame, a fabric or apparel must not melt, drip, or continue to burn after the flame is removed. The properties of material for basic protection level wearing apparel should conform to the minimum requirements for woven or knitted fabrics with respect to breaking load, tear resistance, seam slippage, colorfastness, flammability before and after laundering, and arc testing. ASTM F 1506 specifies these performance characteristics based on fabric weight ranges, expressed in ounces per square yard. ASTM F 1506 establishes that an afterflame may not persist for more than 5 seconds when subjected to the arc testing of ASTM F 1959, discussed below.

ASTM F 1959 provides a test method for measuring the arc thermal performance value of materials intended for use as flame resistant clothing for workers exposed to electric arcs of the magnitude that would generate heat flux rates from between 2 and 600 cal/cm$^2$s. The arc thermal performance value (ATPV) is the incident energy on a fabric or material that results in sufficient heat transfer through the fabric or material to cause the onset of second-degree bums. Incident energy is the total heat energy received at a surface as a direct result of an electric arc. As will be understood by those skilled in the art, the higher the ATPV, the more protective the apparel.

NFPA 70E establishes arc thermal performance acceptance criteria for occupational employee apparel. For outer garments, the minimum acceptable arc thermal performance value is 5.0 cal/cm$^2$.

The rigorous performance specifications of each of the above standards are met by the fabric and safety apparel formed from the unique yarns of the present invention. It has been found that a yarn formed substantially from modacrylic and certain "high performance, high energy absorptive" aramid fibers will yield a fabric and apparel that meet all of the above standards. As used herein, the term "fiber" includes staples and filaments.

Modacrylics have characteristics that solve two of the problems addressed by the present invention. First, modacrylic yarns are inherently flame resistant, with the level of flame resistance varying based upon the weight percentage of acrylonitriles in the composition. Secondly, modacrylic yarns are very receptive to cationic dyes, which are known for their brilliance.

Aramid fibers are manufactured fibers in which the fiber-forming material is a long chain synthetic polyamide having at least 85% of its amide linkages (—NH—CO—) attached directly to two aromatic rings. Poly-para-phenylene terephthalamide is one such aramid which is produced from long molecular chains that are highly oriented with strong interactive bonding. Yarns that include at least about 3 percent of these materials solve the third problem (arc thermal performance) addressed by the present invention. That is, when blended with the modacrylic fibers, the high tensile strength and high energy absorption properties of these materials contribute to high values for thermal performance and resistance to break open (formation of holes) when subjected to an electric arc. As used herein, and as well known in the art, the term "aramid" includes "meta-aramids" such as Nomex® and Conex™, and "para-aramids" such as Kevlar® and Technora®.

In an exemplary embodiment, fabric constructed according to the present invention is formed from yarns that are a blend of modacrylic fibers and poly-paraphenylene terephthalamide fibers that are spun in accordance with conventionally known techniques. It has been found that fabrics formed from such blended yarns, wherein the modacrylic fibers used to form the yarns provide a flame-resistance rating that meets at least the vertical flame burn test minimum criteria for safety apparel. The blended poly-paraphenylene terephthalamide fibers provide strength and energy absorption to meet at least the minimum ATPV for safety apparel. The fabric may be either woven or knit. The inherently flame resistant material is dyed in conventional fashion in a jet dye machine with cationic, or basic, dyestuff compositions to obtain International Yellow or International Orange hues that will meet the luminescence and chromacity requirements of ANSI/ISEA-107-1999.

While the exemplary embodiment described herein is formed from an intimate blend of modacrylic and high performance, high energy absorptive fibers, the yarn may be formed from modacrylic filaments and high performance, high energy absorptive filaments in a uniform distribution to form each yarn end.

These and other aspects of the present invention will become apparent to those skilled in the art after a reading of the following description of the preferred embodiment.

DESCRIPTION OF THE PREFERRED EMBODIMENT

Having described the industry standards that provide the acceptance criteria for basic protection levels for occupational workers, the fabric, and apparel formed therefrom, of the present invention is formed from a yarn that comprises a blend of materials that will meet each of the standards.

In a preferred embodiment, the yarn is a blend comprising at least about 70 percent modacrylic fibers, combined with at least about 3 percent high performance, high energy absorptive fibers of material having a tenacity of at least about 4 grams/denier, flame resistance, affinity for high-visibility dyestuffs, and good energy absorption.

Modacrylics are polymers that have between 35 percent and 85 percent acrylonitrile units, modified by other chemical modifiers such as vinyl chloride. All modacrylics have a flame-resistant character to some extent, however, it has been found that fabrics formed from modacrylic yarns having at least about 50 percent by weight of acrylonitrile units will provide excellent flame resistance. That is, they will not melt and drip, or continue to burn when a source of ignition is removed. Although other modacrylic fibers could be used to form the yarn and fabric of the present invention, the yarn and fabric of the present invention is formed from short staple fibers of Kanecaron® SYS. Kanecaron® SYS is a 1.7 denier, 2 inch modacrylic staple fiber manufactured by Kaneka Corporation, Osaka, Japan. Kanecaron® SYS fiber has a tenacity of about 3 grams/denier, a Young's Modulus of about 270 kg/mm$^2$, a dull luster, and has been found to meet the structural requirements of both ANSI/ISEA-107-1999 and ASTM F 1506. Modacrylic fibers having tenacities of at least about 2 grams/denier are also suitable to form the yarn and fabric of the present invention.

While the modacrylic staple fibers provide highly satisfactory flame resistance and an affinity for luminescent, cationic dyestuffs, the blended yarn containing the aramid fibers provides the added strength and energy absorption needed to meet the arc thermal performance standards of ASTM F 1506 and NFPA 70E.

In one preferred embodiment, modacrylic staple fibers blended with long moledular chain fibers produced from poly-paraphenylene terephthalamide, a para-aramid commonly available from DuPont under the trademark Kevlar®, or available from Teijin Limited of Osaka, Japan under the trademark Technora® provide suitable fire resistance, strength, and energy absorption. These staple fibers have tenacities greater than about 20 grams/denier.

In a second preferred embodiment, it has been found that yarns formed of modacrylic fibers blended with meta-aramid fibers commonly available from DuPont under the trademark Nomex®, or from Teijin Limited under the label Conex™ also provide quite suitable fire-resistance, strength, and energy absorption. These fibers have tenacities greater than about 4 grams/denier.

Fabric formed according to the present invention requires at least about 70 percent modacrylic fibers and at least about 3 percent aramid fibers when blended with one of the aforementioned energy absorptive materials in order to meet the ANSI, ASTM, and NFPA standards described above. Preferably, fabric with blends containing about 90 percent or more of the modacrylic fibers and at least about 3 percent of the high energy absorptive fibers provides the most acceptable results. The following Table I is exemplary of satisfactory fabric constructions that have been formed according to the present invention.

TABLE I

| Construction | modacrylic Fibers | Other Fibers |
|---|---|---|
| A | 90% Kanecoran ® SYS, 1.7 denier, 2.0 inch fibers | 10% Technora ®, 1.7 denier, 2.0 inch fibers |
| B | 95% Kanecoran ® SYS, 1.7 denier, 2.0 inch fibers | 5% Kevlar ®, 1.7 denier, 2.0 inch fibers |
| C | 90% Kanecoran ® SYS, 1.7 denier, 2.0 inch fibers | 10% Nomex ®, 1.7 denier, 2.0 inch fibers |
| D | 90% Kanecoran ® SYS, 1.7 denier, 2.0 inch fibers | 5% Nomex ®, 1.7 denier, 2.0 inch fibers; 5% Kevlar ®, 1.7 denier, 2.0 inch fibers |

In addition to each of these exemplary constructions meeting the acceptance criteria for luminescence and vertical flame exposure, the following Table II illustrates the results of arc testing conducted in accordance with ASTM F 1959.

TABLE II

| Sample | Arc Thermal Performance Value, cal/cm$^2$ | Heat Attenuation, % | Afterflame Duration, sec. |
|---|---|---|---|
| A | 6.6 | 66.8 | 0.0 |
| B | 6.7 | 64.7 | 0.0 |
| C | 6.6 | 65.5 | 0.0 |
| D | 6.7 | 66.7 | 0.0 |

NFPA 70E uses the electrical arc testing data to define electrical safety requirements for employee workplaces involving electrical conductor installations. As such, this standard specifies that protective clothing must have an arc thermal performance exposure value (ATPV) of at least 5 cal/cm$^2$ when the clothing is intended for use as fire resistant outerwear. As shown in Table II, each of the fabric constructions A–D exceeds the minimum requirement of NFPA 70E by about 30 percent. Further, each of the samples has a heat attenuation factor exceeding 60%. As used herein, "heat attenuation factor" refers to the percentage of incident energy which is blocked by a material at a level equal to the arc thermal performance value. Notably, and as also shown in Table II, none of the constructions exhibited any measurable afterflame burning. The acceptance criteria for afterflame burning duration, in accordance with ASTM F 1506, is a maximum of 5 seconds.

The process for making fabric according to the present invention, using the materials described above, is discussed in detail below.

The Process

As is conventional in short staple yarn manufacture, bales of such short staple modacrylic and aramid fibers, in the percentages described above, are initially subjected to an opening process whereby the compacted fibers are "pulled" or "plucked" in preparation for carding. Opening serves to promote cleaning, and intimate blending of fibers in a uniform mixture, during the yarn formation process. Those skilled in the art will appreciate that there are a number of conventional hoppers and fine openers that are acceptable for this process. The open and blended fibers are next carded using Marzoli CX300 Cards to form card slivers. The card slivers are transformed into drawing slivers through a drawing process utilizing a process known as breaker drawing on a Rieter SB951 Drawframe and finisher drawing on a Rieter RSB951 Drawframe. Drawn slivers are next subjected to a Roving process conventionally known in preparation for Ring Spinning. A Saco-Lowell Rovematic Roving Frame with Suessen Drafting is used to twist, lay and wind the sliver into roving. A Marzoli NSF2/L Spinning Frame is used to ring spun the yarn product. Winding, doubling, and twisting processes conventionally known in the art are used in completing the yarn product. A finished yarn found structurally suitable for the present invention is an 18 singles, 2-ply construction.

The illustrated fabric is woven; however, other constructions, such as knitted, and non-woven constructions may be used, provided they meet the design and structural requirements of the two standards.

The exemplary fabric is woven on a Dornier Rapier loom with 46 warp ends and 34 fill ends of yarn per inch and an off-loom width of 68 inches. The usable width of this fabric is approximately 60 inches. Any looms capable of weaving modacrylic yarns may just as suitably be used. The woven fabric has a desired weight of approximately 4 to 20 ounces per square yard, and desirably about 7.5 ounces per square yard as necessary to satisfy the design requirements for the particular class of safety apparel.

In preparation for dyeing, the woven fabric is subjected to desizing and scouring to remove impurities and sizes such as polyacrylic acid. The process of desizing is well known in the art. A non-ionic agent is applied in a bath at between about 0.2 and 0.5 weight percent of the fabric and an oxidation desizing agent is applied in a bath at about 2 to 3 percent of fabric weight. The use of such agents is well known in the art. The processing, or run, time for desizing and scouring is approximately 15 to 20 minutes at 60° C. The fabric is then rinsed with water at a temperature of 60° C.

The pretreated fabric is then ready for dyeing and finishing. The dyeing is formed in a jet dye machine such as a Model Mark IV manufactured by Gaston County Machine Company of Stanley, N.C. The specific dyes used to color the fabric of the present invention are basic, or cationic, dyestuffs. The cationic dyes are known for their acceptability in dyeing polyesters, nylons, acrylics, and modacrylics. However, it has heretofor not been known that these dyes could be formulated to dye modacrylic material in order to meet the luminance and chromacity criteria for safety apparel according to ANSI/SEA-107 and the fire resistant criteria of ASTM F 1506. Two dye formulations have been found to meet the high visibility criteria for ANSI/ISEA-107. A dye formulation for International Yellow comprises basic Flavine Yellow, available from Dundee Color of Shelby, N.C. as color number 10GFF. It has been found that this dyestuff applied at between about 2 to 2½ percent of fabric weight successfully achieves the ANSI criteria. A dye formulation for International Orange may be formed from Blue and Red cationic dyestuffs, available from Yorkshire America in Rock Hill, S.C., as color numbers Sevron Blue 5GMF and Sevron Brilliant Red 4G and applied at percentages sufficient to meet the ANSI/ISEA-107 shade requirements.

Either of the dyestuffs described above are added to the jet dye machine. The Ph of the bath is established at between about 3 and 4, with acid used to adjust the Ph as required. The bath temperature in the jet dyer is raised at about 1° C. per minute to a temperature of about 80° C., where the temperature is held for approximately 10 minutes. The temperature is then raised approximately 0.5° C. per minute to a temperature of 98° C. and held for approximately 60 minutes. The bath is then cooled at about 2° C. per minute to 60° C. At that point, the bath is emptied and rinsing with water at 60° C. occurs until the dye stuff residue in the jet dyer is removed. At this point, the dyeing cycle is complete. Wet fabric is removed from the dye machine where it is dried on a standard propane open width tenter frame running at approximately 40 yards per minute at approximately 280° F. to stabilize width and shrinkage performance. At the completion of this process, a fabric that meets the ANSI standard for high visibility safety apparel, the ASTM standard for flame resistance, and the NFPA Code for arc thermal performance has been formed.

The finished fabric may be used to construct an unlimited number of types of safety apparel. The most common types are shirts or vests, and trousers or coveralls. The final constructed garments are designed and formed to meet the design, structural, and fastening criteria of the ANSI and ASTM standards.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A yarn comprising:

(a) an intimate mixture of modacrylic and high energy absorptive fibers, the modacrylic fibers comprising at least about 70 percent of the fibers;

(b) the modacrylic fibers and high energy absorptive fibers combined in a uniform distribution to form a yarn end; and (c) wherein when said yarn is formed into a fabric comprised substantially of said yarn, said fabric meets the American Society for Testing and Materials standard ASTM F 1506 for flame resistance and the National Fire Protection Association standard NFPA 70E for arc thermal performance exposure.

2. The yarn of claim 1 wherein said modacrylic fibers and said high energy absorptive fibers are intimately blended staple fibers.

3. The yarn of claim 1 wherein the high energy absorptive fibers comprise at least about 3% of the fibers.

4. The yarn of claim 2 wherein said fibers comprise between about 90 percent and 97 percent modacrylic fibers and at least about 3 percent high energy absorptive fibers.

5. The yarn of claim 2 wherein said modacrylic fibers contain at least 50 percent acrylonitrile.

6. The yarn of claim 2 wherein said modacrylic fibers have a tenacity of at least about 2 grams/denier.

7. The yarn of claim 2 wherein the high energy absorptive fibers are aramid.

8. The yarn of claim 7 wherein the selected aramid is formed from poly-paraphenylene terephthalamide.

9. The yarn of claim 2 wherein said high energy absorptive fibers have a tenacity of at least about 4 grams/denier.

10. A fabric for use in safety apparel:

(a) the fabric being formed substantially of flame-resistant yarns formed from an intimate mixture of modacrylic fibers and high energy absorptive fibers, the modacrylic fibers comprising at least about 70 percent of the fibers; and (b) wherein, when a cationic dye is applied to said fabric, the dyed fabric meets the American National Standard Institute standard ANSI/ISEA-107 minimum conspicuity level class requirements for occupational activities for high-visibility safety apparel, the American society for Testing and Materials standard ASTM F-1506 for flame resistance and the National Fire Protection Association standard NFPA 70E for arch thermal performance exposure.

11. The fabric of claim 10 wherein said modacrylic fibers and said high energy absorptive fibers are intimately blended staple fibers.

12. The fabric of claim 10 wherein said fabric is woven.

13. The fabric of claim 10 wherein said yarn comprises at least about 3 percent high energy absorptive fibers.

14. The fabric of claim 11 wherein said blend of fibers comprises between about 90 percent and 97 percent modacrylic fibers and at least about 3 percent high energy absorptive fibers.

15. The fabric of claim 11 wherein said modacrylic fibers contain at least 50 percent acrylonitrile.

16. The fabric of claim 11 wherein said modacrylic fibers have a tenacity of at least about 2 grams/denier.

17. The fabric of claim 11 wherein the high energy absorptive fibers are aramid.

18. The fabric of claim 17 wherein the selected aramid is formed from poly-paraphenylene terephthalamide.

19. The fabric of claim 11 wherein said high energy absorptive fibers have a tenacity of at least about 4 grams/denier.

20. The fabric of claim 12 wherein said woven fabric has a tensile strength of at least about 100 pounds in the warp direction and at least about 100 pounds in the weft direction.

21. The fabric of claim 12 wherein said woven fabric has a tear resistance of at least about 1360 grams.

22. The fabric of claim 10 wherein said fabric is knitted.

23. The fabric of claim 22 wherein said knitted fabric has a bursting strength of at least about 60 pounds.

24. A safety garment having high visibility and flame resistant characteristics formed from:

(a) the fabric being formed substantially of flame-resistant yarns formed from an intimate mixture of modacrylic fibers and high energy absorptive fibers, the modacrylic fibers comprising at least about 70 percent of the fibers;

(b) a cationic dye applied to said fabric; and (c) wherein said dyed fabric meets the American National Standard Institute standard ANSI/ISEA-107 minimum conspicuity level class requirements for occupational activities for high-visibility safety apparel, the American society for Testing and Materials standard ASTM F-1506 for flame resistance and the National Fire Protection Association standard NFPA 70E for arch thermal performance exposure.

25. The garment of claim 24 wherein said modacrylic fibers and said high energy absorptive fibers are intimately blended staple fibers.

26. The garment of claim 25 wherein said fabric is woven.

27. The garment of claim 25 wherein said blend of fibers comprises at least 3 percent high energy absorptive fibers.

28. The garment of claim 25 wherein said blend of fibers comprises between about 90 percent and 97 percent modacrylic fibers and at least about 3 percent high energy absorptive fibers.

29. The garment of claim 25 wherein said modacrylic fibers contains at least 50 percent acrylonitrile.

30. The garment of claim 25 wherein said modacrylic fibers have a tenacity of greater than about 2 grams/denier.

31. The garment of claim 25 wherein the high energy absorptive fibers are aramid.

32. The garment of claim 31 wherein the aramid is formed from poly-paraphenylene terephthalamide.

33. The garment of claim 25 wherein said high energy absorptive fibers have a tenacity of greater than about 4 grams/denier.

34. The garment of claim 26 wherein said woven fabric has a tensile strength of at least about 100 pounds in the warp direction and at least about 100 pounds in the weft direction.

35. The garment of claim 26 wherein said woven fabric has a tear resistance of at least about 1360 grams.

36. The garment of claim 25 wherein said fabric is knitted.

37. The garment of claim 36 wherein said knitted fabric has a bursting strength of at least about 60 pounds.

* * * * *